US007950327B2

(12) United States Patent
Nagata

(10) Patent No.: US 7,950,327 B2
(45) Date of Patent: May 31, 2011

(54) STAMPING DEVICE AND A MEDIA PROCESSING DEVICE

(75) Inventor: Norio Nagata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 753 days.

(21) Appl. No.: 12/070,816

(22) Filed: Feb. 21, 2008

(65) Prior Publication Data

US 2008/0202366 A1 Aug. 28, 2008

(30) Foreign Application Priority Data

Feb. 22, 2007 (JP) ..... 2007-041853
Feb. 22, 2007 (JP) ..... 2007-041854

(51) Int. Cl.
*B41K 3/04* (2006.01)
*B41K 3/08* (2006.01)
*B41K 3/12* (2006.01)

(52) U.S. Cl. ..... 101/328; 101/7; 101/36

(58) Field of Classification Search ..... 101/5–7, 101/22, 23, 36, 316, 327, 328
See application file for complete search history.

(56) References Cited

U.S. PATENT DOCUMENTS

| | | | | | |
|---|---|---|---|---|---|
| 4,121,516 | A * | 10/1978 | Amelot et al. | 101/23 |
| 4,557,191 | A * | 12/1985 | Speicher | 101/4 |
| 4,572,067 | A * | 2/1986 | Fischer | 101/7 |
| 4,715,298 | A * | 12/1987 | Weickert et al. | 101/269 |
| 4,852,382 | A * | 8/1989 | Gietz et al. | 72/406 |
| 5,460,088 | A * | 10/1995 | Heiler et al. | 101/142 |
| 5,503,514 | A * | 4/1996 | LaManna et al. | 101/23 |
| 5,764,250 | A * | 6/1998 | Tenenbaum et al. | 346/80 |
| 6,227,108 | B1 * | 5/2001 | Kempen et al. | 101/120 |
| 6,705,224 | B2 * | 3/2004 | Kuroda et al. | 101/371 |
| 2002/0148578 | A1 * | 10/2002 | Reilly et al. | 162/109 |
| 2004/0231530 | A1 * | 11/2004 | Lines et al. | 101/6 |

FOREIGN PATENT DOCUMENTS

| | | |
|---|---|---|
| JP | 06-064297 | 3/1994 |
| JP | 06-227109 | 8/1994 |
| JP | 07-108748 | 4/1995 |
| JP | 09-263031 | 10/1997 |
| JP | 2003-034067 | 2/2003 |
| JP | 2003-141367 | 5/2003 |

* cited by examiner

*Primary Examiner* — Ren Yan
*Assistant Examiner* — David Banh
(74) *Attorney, Agent, or Firm* — Nutter McClennen & Fish LLP; John J. Penny, Jr.; Michael P. Visconti, III

(57) ABSTRACT

A stamping device comprising a stamp, a drive mechanism for moving the stamp between a printing position and a standby position, and a return urging member that urges the stamp towards the standby position in order to return the stamp to the standby position if the drive mechanism becomes inoperable.

13 Claims, 5 Drawing Sheets

STAMPING DEVICE AND A MEDIA PROCESSING DEVICE

Priority is claimed under 35 U.S.C. §119 to Japanese Application No. 2007-041853 filed on Feb. 22, 2007 and Japanese Application No. 2007-041854 filed on Feb. 22, 2007, both of which are incorporated by reference in their entirety.

BACKGROUND OF THE INVENTION

1. Technical Field

The present invention relates to a stamping device that stamps letters and the like on print media by pressing a stamp against the print media by means of a drive mechanism using a motor or other actuator. The invention also relates to a media processing device such as a check processing device having the stamping device.

2. Description of Related Art

A stamping device of this type is used in a check reader such as described in JP-A-2003-141367, for example. While conveying checks, promissory notes, and similar financial instruments (referred to as simply "checks" below) through a media transportation path, a check reader reads magnetic ink characters using a magnetic head disposed in the transportation path, images the check using a scanner, and then drives the stamping device to stamp the check with "PROCESSED," for example, after scanning is completed.

If the drive mechanism of the stamping device fails to operate, such as when the drive mechanism stops because of a power failure during operation, the stamp may be left pressed against the paper or other print medium. If the stamp is left pressed against the print medium, ink will continue to be supplied from the transfer surface of the stamp to the print medium and the print medium may become soiled with ink. If the print medium is forcibly removed, the surface of the print medium becomes smeared with ink as the print medium is pulled over the surface of the stamp. After the print medium is removed, the stamp will also be left pressed directly against the guide surface that guides the print medium instead of against the print medium, and ink will soil the guide surface. If the guide surface becomes soiled with ink, the ink on the guide surface will then soil the back side of the next print medium when it passes over the guide surface for printing.

If the stamp, which is pushed by a drive mechanism using a motor or other actuator, of the stamping device is not pressed against the surface of the print medium with uniform pressure, ink transfer and stamp life, for example, will vary. In order to maintain uniform stamp pressure, the printing position where the stamp is pressed to the print medium must be managed with good precision. Variation in the printing position of the stamp necessarily occurs, however, as a result of dimensional variation in the parts in the stamp drive mechanism, differences in the assembly of the parts, and deviation in the detection precision of the detectors that detect stamp movement and position. It is therefore not possible to manage the stamping pressure of the stamp with good precision.

SUMMARY OF THE INVENTION

A stamping device according to the present invention automatically releases the pressure of the stamp against the print medium in the event the stamp drive mechanism becomes unable to operate.

A stamping device according to at least one embodiment of the invention keeps the pressure of the stamp against the print medium constant even if there is deviation in the printing position where the stamp is pressed against the print medium.

A stamping device according to at least one embodiment of the invention has a stamp, a drive mechanism for moving the stamp between a printing position and a standby position, and a return urging member that constantly urges the stamp towards the standby position in order to return the stamp to the standby position if the drive mechanism becomes inoperable.

An urging force constantly urges the stamp to return toward the standby position in a stamping device according to at least one embodiment of the present invention. If the strength of this urging force is set appropriately, the stamp that is pressed against the print medium at the printing position is urged away from the print medium and the pressure of the stamp against the print medium is released when the power supply to the drive mechanism that uses a motor or other type of actuator is interrupted. The stamp can also be returned automatically to the standby position by this urging force. Problems caused by the stamp being left pressed against the print medium and ink bleeding from the transfer surface of the stamp and soiling the print medium can be avoided. It is also not necessary to manually return the stamp to the standby position when a power failure occurs, for example, because the stamp automatically returns to the standby position.

The drive mechanism of the stamping device preferably has a slider on which the stamp is carried, and a slider drive mechanism for moving the slider, and the return urging member is a spring member that pulls the slider toward the standby position.

In the stamping device according to another aspect of at least one embodiment of the invention, the drive mechanism has a stamp mounting block to which the stamp is mounted, a slider that supports the stamp mounting block slidably toward the standby position relative to the slider, an elastic member that limits relative movement of the stamp mounting block toward the standby position, and a slider drive mechanism for moving the slider.

By causing the slider to move toward the printing position, the slider drive mechanism can position the stamp so that the stamp transfer surface is positioned to a printing position in contact with the print medium. After the slider drives the stamp in contact with the surface of the print medium, moving the slider further in the same direction increases the pressure of the stamp against the print medium. The elastic member holds the stamp mounting block to which the stamp is affixed so that the stamp mounting block does not move relatively toward the standby position. If the pressure on the stamp increases, the elastic member elastically deforms and the stamp mounting block moves toward the standby position relative to the slider. The pressure of the stamp against the print medium is thus held constant by elastic deformation of the elastic member.

If the printing position of the stamp is set to a position where the elastic member is deformed a prescribed amount, the stamp mounting block moves relative to the slider even if the printing position of the stamp, which is limited by slider movement, varies front-to-back. As a result, the stamp is pressed with uniform pressure by the elastic force of the elastic member against the surface of the print medium at the printing position.

If the slider is provided with a printing position side stopper and a standby position side stopper that limit the relative movement range of the stamp mounting block, a spring member that is disposed to urge the stamp mounting block toward the printing position side stopper can be used as the urging member.

If a common slider guide shaft is used to guide both the slider and the stamp mounting block, the printing position side stopper and the standby position side stopper of the slider are freely slidably supported on the slide guide shaft, a printing position side arm part and a standby position side arm part are disposed to the stamp mounting block on the slide guide shaft between the printing position side stopper and the standby position side stopper, and the elastic member can be a coil spring mounted in tension between the printing position side stopper of the slider and the standby position side arm part of the stamp mounting block.

A stepping motor, which affords a faster operating speed than a solenoid plunger or a dc motor, can be used as the drive power source of the drive mechanism.

In this case, the urging force of the return urging member that urges the stamp toward the standby position is preferably greater than the restrictive force that restricts stamp movement and is produced by the detent torque of the stepping motor and the drive load of the drive mechanism. If the stamp is pressed against the print medium when the power supply to the stepping motor is interrupted, this arrangement enables the automatic return of the stamp to the standby position.

If the drive mechanism does not have a source of detent torque such as a stepping motor, the urging force of the return spring member is set greater than the sliding load of the slider.

The stamp is preferably a rotating roller having a stamp transfer surface formed on the annular outside surface. This arrangement enables the roller pressed against the surface of the moving print medium to print on the print medium surface as the roller turns in conjunction with movement of the print medium.

A media processing device according to another aspect of at least one embodiment of the invention has the stamping device described herein. By disposing the stamping device on the print medium transportation path of a media processing device such as a check reader, the stamp can be prevented from being left pressed against the processed check or other print medium if the drive mechanism cannot operate.

Furthermore, by disposing the stamping device described above on the print media transportation path of a media processing device such as a check reader, processed checks and other print media can be stamped with "PROCESSED," for example, with good print quality.

A stamping device according to at least one embodiment of the present invention has a return spring member that constantly urges the stamp in a direction that causes the stamp to return to a standby position. If the urging force of this return spring member is set appropriately, the stamp can be automatically released from the stamping position and the print medium or the guide surface of the print medium can be prevented from being soiled with ink in the event the power supply to the motor is interrupted while the stamp is pressed against the print medium. The stamp can also be automatically returned to the standby position.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a stamping device according to at least one embodiment of the present invention is described below with reference to the accompanying figures.

Figure 1A:
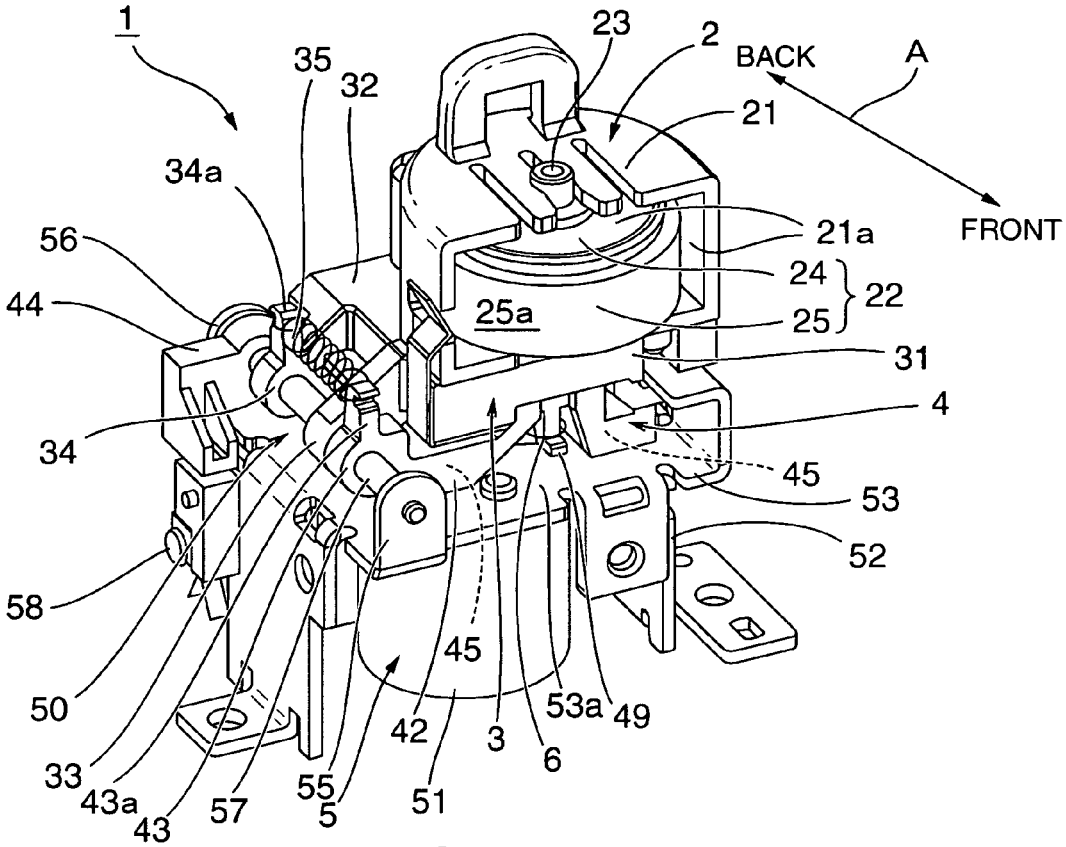
FIG. 1A is an oblique view of a stamping device according to at least one embodiment of the present invention.
Figure 1B:
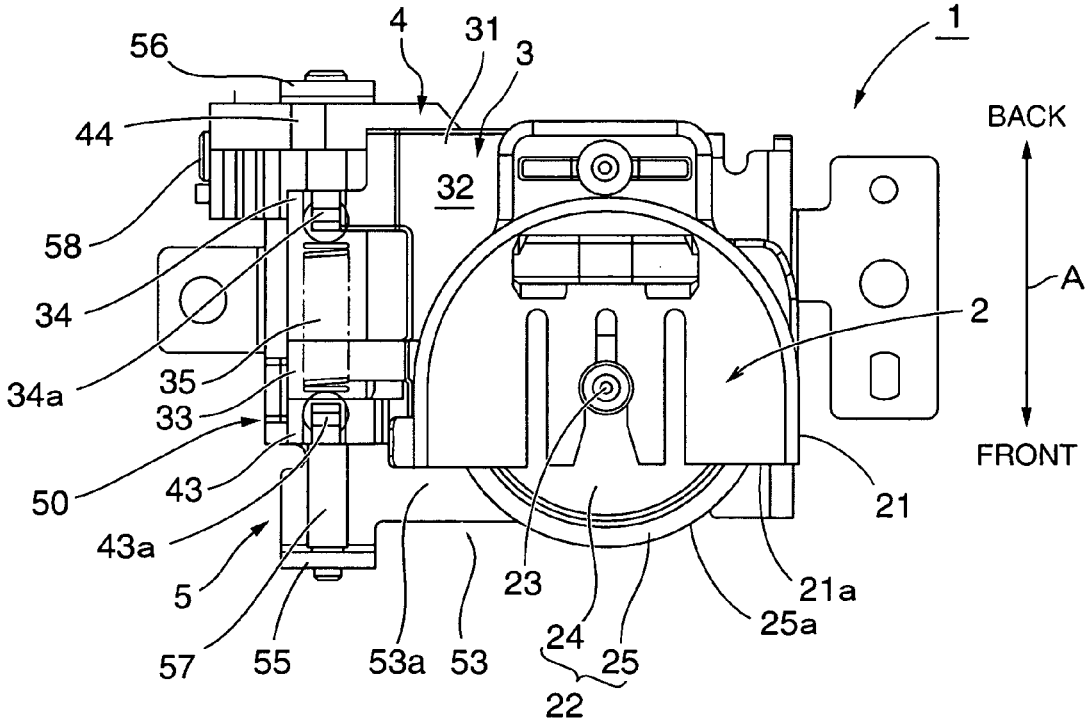
FIG. 1B is a plan view of the stamping device shown in FIG. 1A.
Figure 2A:
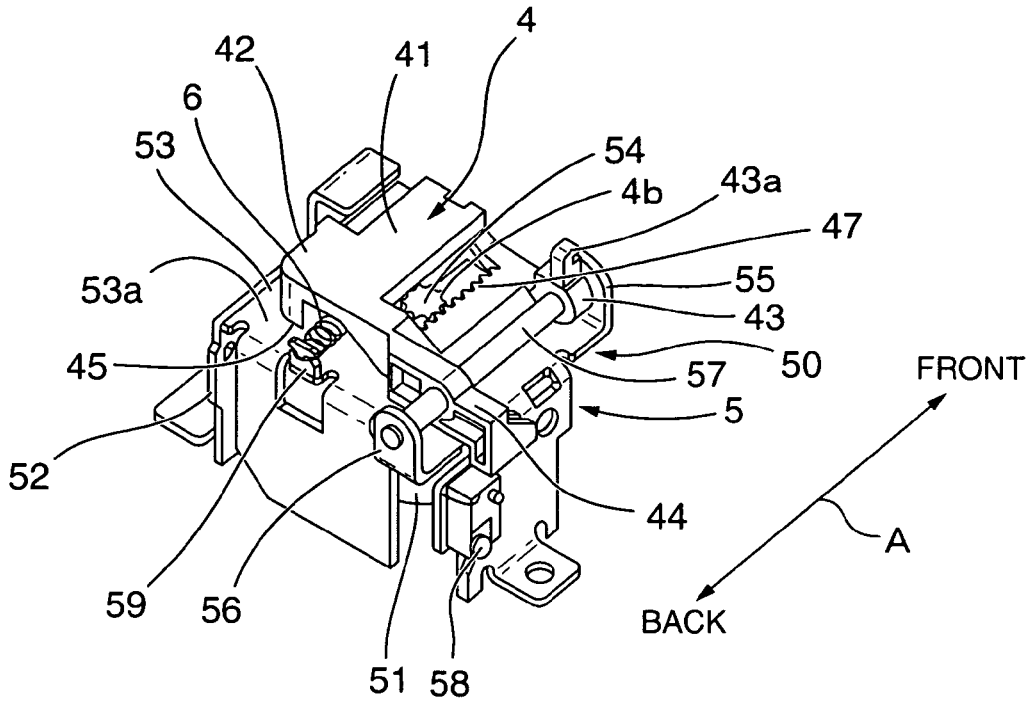
FIG. 2A is an oblique view of the stamping device shown in FIG. 1A with some parts removed.
Figure 2B:
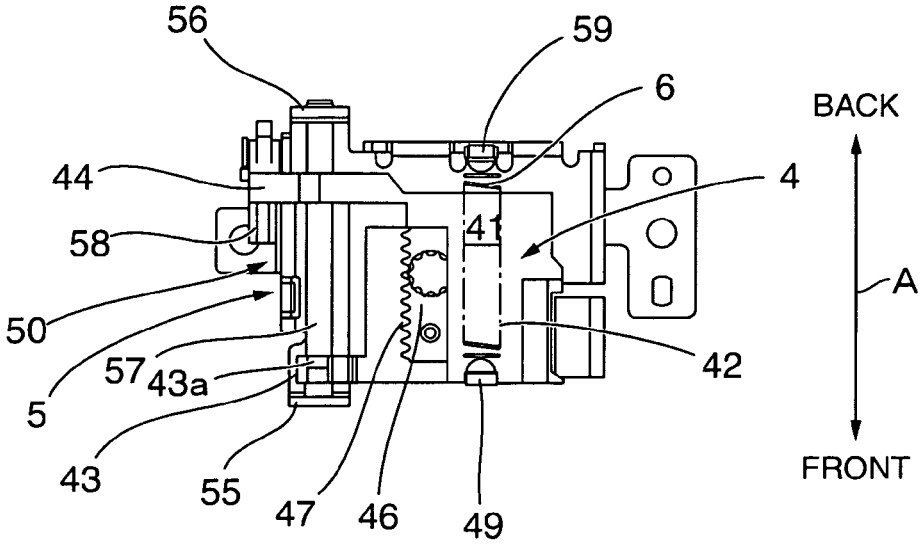
FIG. 2B is a plan view of the stamping device shown in FIG. 1A with some parts removed.

FIG. 1A and FIG. 1B are an oblique view and a plan view, respectively, of the stamping device, and FIG. 2A and FIG. 2B are an oblique view and a plan view, respectively, of the stamping device with the stamp and the stamp mounting block removed from the stamping device.

The stamping device 1 according to this embodiment of the invention has a stamp 2 and a drive mechanism for moving the stamp 2 along a front to back axis between the standby position shown in the figure and the forward printing position. The drive mechanism in this embodiment has a stamp mounting block 3 to which the stamp 2 is attached, a slider 4 to which the stamp mounting block 3 is mounted, and a slider drive mechanism 5 that moves the slider 4 on the front-to-back axis indicated by arrow A.

The slider drive mechanism 5 has a guide mechanism 50 that supports the slider 4 slidably on the front-to-back axis, and a stepping motor 51 as the drive power source. The stepping motor 51 is attached facing up on the bottom of the rectangular top plate 53 portion of a gantry frame 52 (see FIG. 2A). Screw holes are formed in the gantry frame 52 for attaching the gantry frame 52 to a check reader, for example. The rotating shaft (not shown in the figure) of the stepping motor 51 protrudes through a window 46 formed in the top plate 53, and a pinion 54 is attached to the distal end of the shaft as shown in FIG. 2B.

The guide mechanism 50 has a flat top surface 53*a* formed on the top plate 53, a front support bracket 55 and a back support bracket 56 that rise vertically from the front and back edges at one side part of the top plate 53, and a slider guide shaft 57 extending horizontally front to back between the front support bracket 55 and back support bracket 56, as shown in FIG. 2A.

As shown in FIG. 2A and FIG. 2B, the slider 4 has a main part 42 with a flat top part 41, a front arm 43 (printing position stopper) and back arm 44 (standby position stopper), and flat left and right side sliding surfaces 45 formed on the bottom of the main part 42.

The front arm 43 and back arm 44 protrude to the side from the front and back ends on one side of the main part 42. The slider guide shaft 57 passes freely slidably through the front arm 43 and the back arm 44, and the flat sliding surfaces 45 rest slidably on the flat top surface 53*a* of the top plate 53 of the gantry frame 52. The slider 4 can thus slide front-to-back along the slider guide shaft 57.

As will also be known from FIG. 2A and FIG. 2B, a window 46 is formed in the main part 42 of the slider 4 where the pinion 54 protrudes from below, and a rack 47 that engages the pinion 54 is formed on one front-to-back side of the window 46. When the stepping motor 51 turns, the slider 4 is driven to slide front to back by means of the rack 47 and pinion 54.

The front sliding limit of the slider 4 is the position where the front arm 43 contacts the front support bracket 55 of the gantry frame 52, and the back sliding limit of the slider 4 is the position where the back arm 44 contacts the back support bracket 56 of the gantry frame 52. In this embodiment of the invention, the retracted position of the slider 4 is the sliding limit position determined by the back support bracket 56. The distance the slider 4 slides forward from this retracted position is managed by counting the number of steps the stepping motor 51 turns based on a detection signal from a position detector 58 disposed on the gantry frame 52 to control the advancement position of the slider 4 (the printing position of the stamp 2).

As shown in FIG. 2A and FIG. 2B, a front spring catch 49 that protrudes down is formed at the front center part of the main part 42 of the slider 4. A rear spring catch 59 that protrudes up is also formed at the back center part of the top plate 53 of the gantry frame 52. A return coil spring 6 is mounted in tension between these front and back spring catches 49 and 59. When the stepping motor 51 is inoperable, such as when the power supply to the stepping motor 51 stops unexpectedly, the tension of the return coil spring 6 can forcibly return the slider 4 to the retracted position from any other position.

This embodiment of the invention uses a return coil spring 6 that produces greater spring force than the sum of the detent torque load of the stepping motor 51 and the sliding load that occurs when the slider 4 is pushed back along the slider guide shaft 57. As a result, if an unexpected power outage occurs, the slider 4 positioned anywhere forward from the retracted position is reliably pushed back and automatically returned to the retracted position by the force of the return spring 6.

As shown in FIG. 1A and FIG. 1B, the stamp mounting block 3 has a main mounting block part 31, a front arm part 33 (printing position side arm) and a back arm part 34 (retracted position side arm). The main mounting block part 31 rests slidably on the front-to-back axis on the flat top part 41 of the main part 42. The front arm part 33 and the back arm part 34 project to the side from the front and back ends of one side of the main mounting block part 31. The slider guide shaft 57 passes freely slidably through the front arm part 33 and back arm part 34. The front arm part 33 and back arm part 34 are positioned between the front arm 43 and back arm 44 of the slider 4. The stamp mounting block 3 can therefore slide front-to-back along the slider guide shaft 57, can slide forward until the front arm part 33 meets the front arm 43 of the slider 4, and can slide to the back until the back arm part 34 meets the back arm 44 of the slider 4.

A front spring catch 43*a* is formed projecting up from the front arm 43 of the slider 4, and a back spring catch 34*a* is formed projecting up from the back arm part 34 of the stamp mounting block 3. A coil tension spring 35 is mounted in tension between the front and back spring catches 43*a* and 34*a*. The stamp mounting block 3 is thus held with the front arm part 33 pushed against the front arm 43 of the slider 4, and can slide forward and back with the slider 4. If the stamp mounting block 3 is pushed back with greater force than the tension of the coil tension spring 35, the stamp mounting block 3 can slide to the back relative to the slider 4.

The stamp 2 is fixed to the top 32 of the main mounting block part 31 of the stamp mounting block 3. The stamp 2 includes a stamp case 21 and a stamp roller 22. The outside circumference part of the stamp roller 22 protrudes a prescribed amount to the front from a front opening 21*a* in the stamp case 21. The roller shaft 23 of the stamp roller 22 is supported vertically by the stamp case 21 so that the roller shaft 23 can rotate.

The stamp roller 22 includes a flat cylindrical ink tank 24 and an annular transfer member 25 made of a porous material concentrically covering the outside of the ink tank 24. The transfer member 25 is impregnated with ink so that the ink permeates the outside transfer surface 25*a*. An ink transfer part that is a negative image of the printed letters is formed on the transfer surface 25*a*. When the transfer surface 25*a* is pressed against the surface of the print medium, ink passes from the ink transfer part and the stamped letters are transferred to the print medium. To extend ink life, an arrangement that has an ink storage tank located at a position that contacts the transfer member 25 to ink the transfer member 25 is also possible.

Printing and Automatically Returning the Stamp

Figures 3A, 3B, 3C:
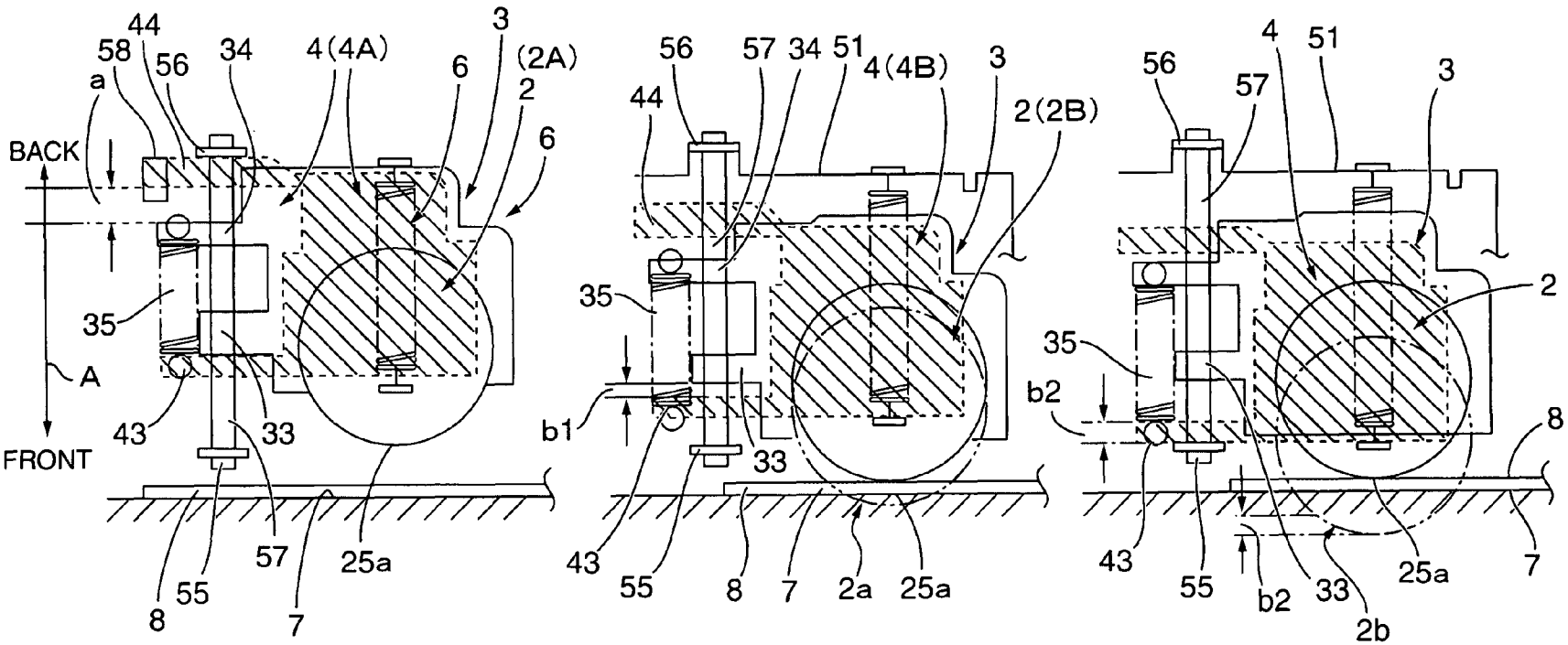
FIG. 3A, FIG. 3B, and FIG. 3C describe the operation of the stamping device shown in FIGS. 1A and 1B.

FIG. 3A to FIG. 3C describe the operation of the stamping device 1. FIG. 3A shows the standby position, and FIG. 3B and FIG. 3C show the stamp 2 pressed against the print medium. Note that the slider 4 is indicated by the shaded portion with a dotted contour line.

In the standby position shown in FIG. 3A, the slider 4 is held by the return coil spring 6 in the retracted position 4A pressed against the back support bracket 56 of the gantry frame 52. The stamp mounting block 3 riding on the slider 4 is also pressed by the coil tension spring 35 against the front arm 43 of the slider 4, and the stamp 2 mounted on the stamp mounting block 3 is in the standby position 2A. There is a gap a between the back arm part 34 of the stamp mounting block 3 and the back arm 44 of the slider 4 in this position.

When the stepping motor 51 is driven from this position to slide the slider 4 to the front, the slider 4 is detected by the position detector 58. How far the slider 4 slides forward is managed by counting the number of steps the stepping motor 51 drives from when the position detector 58 detects the slider 4. The stamp mounting block 3 mounted thereon advances in unison when the slider 4 advances. The stamp 2 therefore also advances in unison with the slider 4.

As shown in FIG. 3B, the slider 4 reaches the forward position 4B when the stepping motor 51 drives a predetermined number of steps. This number of steps is set so that the stamp 2 reaches the printing position 2B just before the slider 4 reaches the forward position 4B. More specifically, the number of steps is set so that the transfer surface 25*a* of the stamp 2 touches the surface of the print medium 8 positioned at the media guide surface 7 that defines a portion of the media transportation path in a media processing device such as a check reader. In other words, if the media guide surface 7 and print medium 8 are not present, the stamp 2 advances to the position indicated by the imaginary line 2*a* when the slider 4 reaches the forward position 4B. Because advancement of the stamp 2 is prevented when the stamp 2 contacts the surface of the print medium 8, the stamp mounting block 3 to which the stamp 2 is attached cannot advance with the slider 4.

As a result, the stamp mounting block 3 slides to the back relative to the slider 4 while stretching the coil tension spring 35 as the slider 4 advances, and the front arm part 33 is separated by gap b1 from the front arm 43 of the slider 4. Therefore, when the slider 4 reaches the forward position 4B, the stamp 2 mounted on the stamp mounting block 3 is pressed against the surface of the print medium 8 with a constant pressure determined by the force of the coil tension spring 35 at the printing position 2B pressed to the surface of the print medium 8. The surface of the print medium 8 traveling along the media guide surface 7 is thus printed.

What happens when the forward position 4B of the slider 4 driven by the slider drive mechanism 5 shifts on the front-to-back axis is described next. If the forward position of the slider 4 shifts a forward distance b2 from the forward position 4B shown in FIG. 3C, the stamp 2 is pressed to the surface of the print medium 8 with the stamp mounting block 3 slid to the back relative to the slider 4 an amount (distance b2) equal to the distance the forward position of the slider 4 has shifted forward. More specifically, when the media guide surface 7 and print medium 8 are not present, the stamp 2 advances to the position indicated by imaginary line 2*b* at a distance b2 forward from the position of the imaginary line 2*a* shown in FIG. 3C, and the stamp mounting block 3 retracts this additional distance b2 relative to the slider 4. However, when the stamp 2 is at the printing position 2B pressed to the surface of the print medium 8 in this case, the stamp 2 is held pressed to the surface of the print medium with the uniform pressure of the spring force of the coil tension spring 35.

Conversely, if the forward position 4B of the slider 4 shifts to the back, the distance the stamp mounting block 3 slides back relative to the slider 4 decreases. When the stamp 2 is at the printing position 2B pressed to the surface of the print medium 8 in this situation, the spring force of the coil tension spring 35 again causes the stamp 2 to be pressed with the same uniform pressure against the surface of the print medium 8.

The stamp mounting block 3 can thus slide a gap a to the back relative to the slider 4 (that is, the direction towards the retracted position of the stamp 2). A shift forward or back in the forward position 4B of the slider 4 is thus absorbed by the stamp mounting block 3 sliding to the back relative to the slider 4, and the stamp 2 on the stamp mounting block 3 is pressed to the surface of the print medium 8 with constantly uniform pressure by the spring force of the coil tension spring 35.

The slider 4 is also always pulled toward the retracted position 4A by the return coil spring 6 in the stamping device 1 according to this embodiment of the invention. Therefore, if the power supply to the stepping motor 51 is interrupted when the slider 4 is moving from the retracted position 4A to the forward position 4B or when the slider 4 is being held at the forward position 4B, the slider 4 will not stop at that position and will be pulled back to the retracted position 4A. In other words, the force of the return coil spring 6 pulls the slider 4 to the retracted position 4A where the back arm 44 of the slider 4 contacts the back support bracket 56 of the gantry frame 52, and the condition shown in FIG. 3A is automatically restored.

This prevents the transfer surface 25*a* of the stamp 2 from being left pressed against the surface of the print medium 8 if the power supply is interrupted while printing. Ink is also prevented from soiling the media guide surface 7, for example. It is also not necessary to return the stamp 2 to the standby position 2A if an equipment failure occurs.

Other Embodiments of a Stamping Device

A stepping motor 51 is used as the drive power source for sliding the slider 4 in the embodiment described above. A motor other than a stepping motor can be used if a slower operating speed is acceptable, however. A plunger could also be used. If a drive power source that produces detent torque, such as a stepping motor, is not used, the urging force of the return coil spring 6 must simply be set greater than the total sliding resistance of the slider 4.

A construction having the stamp 2 affixed to a stamp mounting block 3 is used in the above example so that the stamp pressure remains constant, but the stamp 2 can be mounted directly to the slider 4 if variation in the stamp pressure is not a problem, for example.

The coil tension spring 35 in the above example holds the stamp mounting block 3 so that it does not move to the back relative to the slider 4. Alternatively, the back end of the stamp mounting block 3 could be supported by a compression spring member or by a compressively deformable elastically-deformable member so that if the stamp 2 is pressed to the print medium 8 and the stamp mounting block 3 is pushed back, the spring member or elastically deformable member is compressed and the stamp 2 is pressed with uniform pressure to the print medium 8.

Media Processing Device Having the Stamping Device

Figure 4:
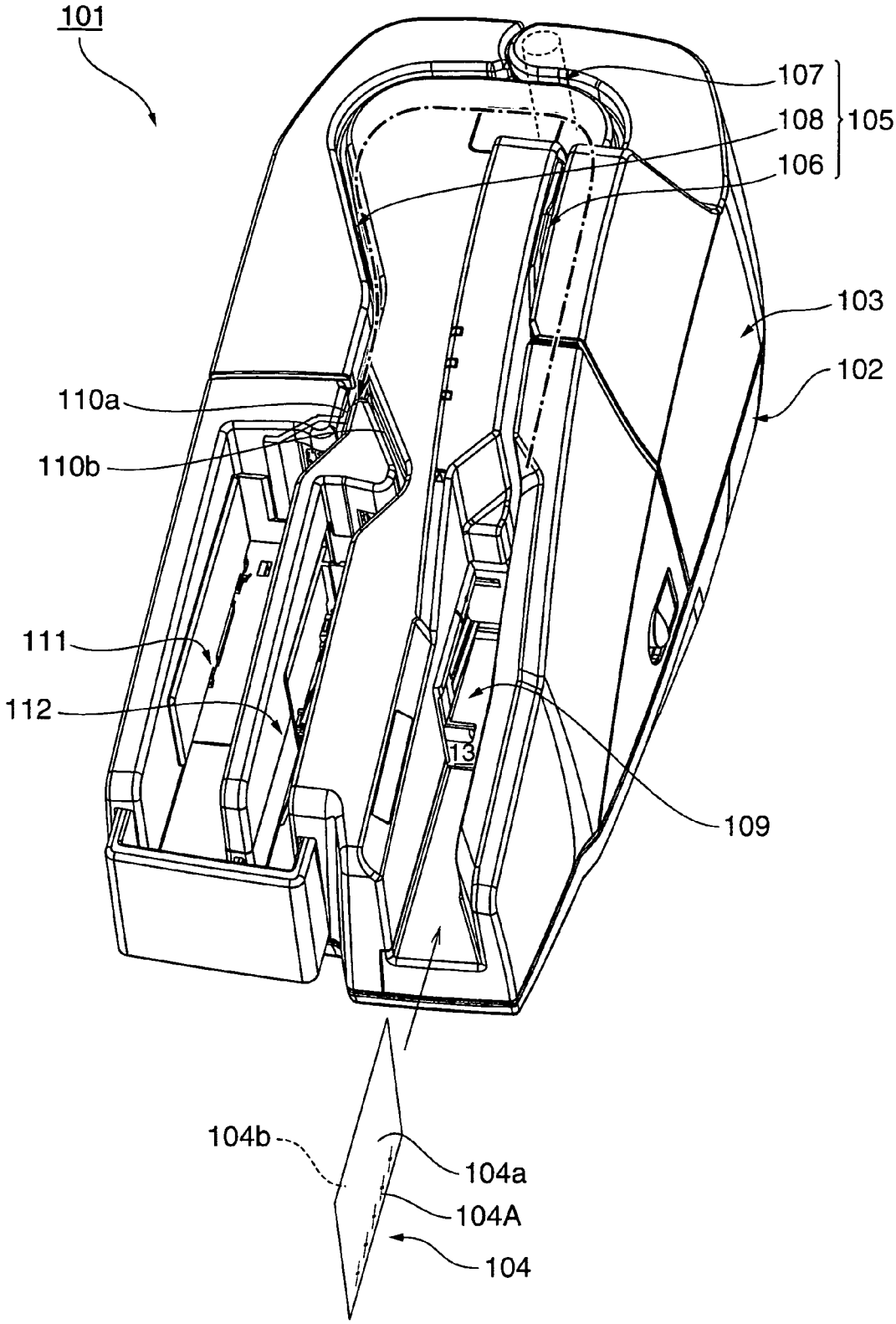
FIG. 4 is an external oblique view of a check processing device having the stamping device shown in FIGS. 1A and 1B.

FIG. 4 is an oblique view of a check reader as an example of a media processing device having the stamping device described above.

This check processing device 101 has a case 102 and a cover case 103 that covers the top of the lower case 102, and various parts and assemblies are disposed inside the case. A transportation path 105 for conveying checks 104 (print media) is formed in the cover case 103.

The check transportation path 105 is a narrow vertical slot that curves in a basically U-shaped configuration when seen from above, and includes a straight upstream-side transportation path portion 106, a curved transportation path portion 107 that continues from the upstream-side transportation path portion 106, and a slightly curving downstream-side transportation path portion 108 that continues from the curved transportation path portion 107.

The upstream end of the upstream-side transportation path portion 106 communicates with a check loading unit 109, which is a wide vertical slot. The downstream end of the downstream-side transportation path portion 108 is connected through left and right diversion paths 110*a*, 110*b* to first and second check discharge units 111 and 112, which are wide vertical slots.

The checks 104 that are read have an MICR line 104A printed along the bottom edge on the front 104*a* of the check 104. Also recorded on the front 104*a* against a patterned background are the check amount, payer and payee, various numbers, and the payer signature. An endorsement is recorded on the back 104*b* of the check 104.

Figure 5:
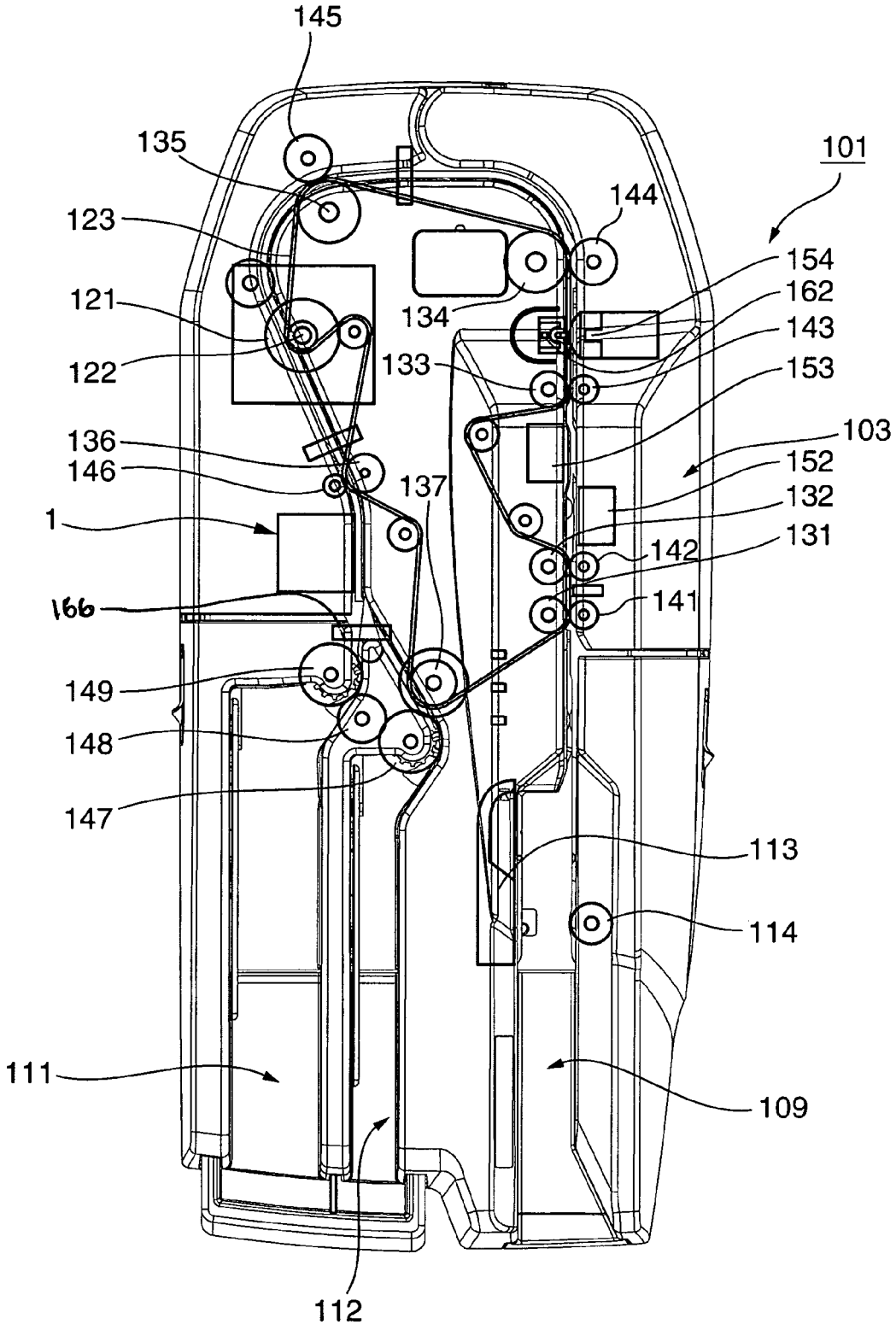
FIG. 5 describes the internal arrangement of the check processing device shown in FIG. 4.

FIG. 5 describes the internal construction of the check processing device 101. An infeed roller 113 for feeding checks 104 loaded in a stack in the check loading unit 109 one by one into the transportation path 105, and a pressure member 114 for pressing the checks 104 against the infeed roller 113, are disposed to the check loading unit 109.

The transportation mechanism for conveying the checks 104 along the transportation path 105 includes a transportation motor 121, a drive pulley 122 mounted on the rotating shaft of the transportation motor 121, a set of transportation rollers 131 to 137 disposed along the transportation path 105, and a set of pressure rollers 141 to 147 that are pressed against and rotate with the transportation rollers 131 to 137.

Rotation of the pressure roller 147 is transferred through a transfer gear 148 to a discharge roller 149. An endless belt 123 transfers rotation of the transportation motor 121 shaft to the transportation rollers 131 to 137.

The transportation rollers 131 to 134 are located at the upstream end and the middle of the upstream-side transportation path portion 106, and at the junction of the upstream-side transportation path portion 106 with the curved transportation path portion 107. Transportation roller 135 is located on the downstream side of the curved transportation path portion 107. Transportation roller 136 is in the middle of the downstream-side transportation path portion 108, and transfer roller 137 is located at the discharge opening of the second check discharge unit 112. A discharge roller 149 is disposed at the discharge opening of the first check discharge unit 111.

A front contact image sensor 152 is disposed as the front image scanner, and a back contact image sensor 153 is disposed as a back image scanner, between the transportation rollers 132 and 133. A magnetic head 154 for magnetic ink character reading is disposed between transportation rollers 133 and 134. The stamping device 1 is disposed at the downstream-side transportation path portion 108 on the downstream side of the transportation roller 136. The stamping device 1 can move between a printing position pressed against the check 104, and a retracted position where the stamping device 1 is retracted from the printing position.

A flapper 166 that is driven by a drive motor not shown to switch the discharge path is disposed on the upstream side of the diversion paths 110*a* and 110*b*. The flapper 166 selectively switches the downstream end of the transportation path 105 to the first check discharge unit 111 or the second check discharge unit 112, and guides the check 104 to the selected discharge unit.

The basic operation of this check processing device 1 is described below.

When the operator inputs a start scanning command from a host computer system (not shown in the figure), for example, the infeed roller 113 turns and the pressure member 114 moves to press the checks 104 against the infeed roller 113. A check 4 is thus advanced by the infeed roller 113 into the transportation path 105. The transportation motor 121 also operates and rotationally drives the transportation rollers 131 to 137.

The check 104 that was fed into the transportation path 105 is passed sequentially to the transportation rollers 131 to 136 and conveyed through the transportation path 105. The front and back of the check 104 are imaged and the magnetic ink characters are read by the front contact image sensor 152, the back contact image sensor 153, and the magnetic head 154, respectively.

The captured data is then sent to the host computer system. The computer system processes the scanned front image, back image, and magnetic ink character data, and determines if the check was read correctly. If the check 104 is fed with the top and bottom upside down, the magnetic ink characters cannot be recognized and a read error results. If the check 104 is fed with the front and back reversed, the magnetic ink character data cannot be acquired and a read error results. If the check 104 is creased, torn, or skewed when fed so that a portion of the magnetic ink characters cannot be read, a read error results. A read error also results if the check amount or other prescribed information cannot be recognized from the front and back image data because, for example, the check 104 is creased, torn, or skewed when fed.

If it is determined that the check 104 was scanned correctly, the stamp 2 of the stamping device 1 moves to the printing position (stamping position 2B). The check 104 is advanced while the stamping device 1 prints PROCESSED, for example, on the check 104, and the check 104 is directed into the first check discharge unit 111 by the flapper 166.

If it is determined that a read error occurred or reading was not possible, the flapper 166 changes position. The stamp 2 of the stamping device 1 is held in the standby position 2A and does not print on the check 104. The check 104 is thus diverted by the flapper 166 and discharged into the second check discharge unit 112.

It will be obvious that the stamping device of the invention can be used in media processing devices other than check processing devices.

The invention being thus described, it will be obvious that it may be varied in many ways. Such variations are not to be regarded as a departure from the spirit and scope of the invention, and are intended to be included within the scope of the following claims.

What is claimed is:

1. A stamping device comprising:

a stamp;

a drive mechanism for moving the stamp between a printing position and a standby position, the drive mechanism including:

a guide shaft, a slider slidably engaging the guide shaft, a slider drive mechanism for moving the slider, a stamp mounting block on which the stamp is mounted, the slider being movable relative to the stamp mounting block towards and away from the printing position, the stamp mounting block slidably engaging the guide shaft, an elastic member which biases the stamp mounting block towards the printing position, and a return urging member that urges the slider towards the standby position such that the slider is returned to the standby position if the drive mechanism becomes inoperable so that the slider pulls the stamp mounting block away from the printing position.

2. The stamping device described in claim 1, wherein the return urging member is a spring member that pulls the slider towards the standby position.

3. The stamping device described in claim 1, wherein:

the stamp mounting block has a standby position side stopper and a printing position side stopper that limit a relative movement range of the slider; and the elastic member is a spring member that urges the stamp mounting block towards the printing position side stopper.

4. The stamping device described in claim 3, wherein:

the guide shaft guides both the slider and the stamp mounting block;

the printing position side stopper and the standby position side stopper of the slider are freely and slidably supported on the guide shaft;

the stamp mounting block has a printing position side arm part and a standby position side arm part slidably disposed on the slider guide shaft between the printing position side stopper and the standby position side stopper; and the elastic member is a coil spring mounted in tension between the printing position side stopper of the slider and the standby position side arm part of the stamp mounting block.

5. The stamping device described in claim 1, wherein:

the drive mechanism has a stepping motor.

6. The stamping device described in claim 5, wherein:

the urging force of the return urging member that urges the slider toward the standby position is greater than the restrictive force that restricts slider movement and is produced by the detent torque of the stepping motor and the drive load of the drive mechanism.

7. The stamping device described in claim 1, wherein:

the stamp is a rotating roller having a stamp transfer surface formed on an annular outside surface.

8. A media processing device comprising the stamping device described in claim 1.

9. The stamping device described in claim 1, wherein:

the stamp mounting block includes a front arm part and a back arm part;

the slider includes a front arm and a back arm; and the front arm part and the back arm part are positioned such that the stamp mounting block can slide forward until the front arm part contacts the front arm and the back arm part contacts back arm.

10. The stamping device described in claim 9, wherein when the stamp reaches the printing position, the stamp mounting block slides relative to the slider in a direction away from the printing position such that a gap forms between the front arm part and the front arm.

11. The stamping device described in claim 1, wherein the slider drive mechanism is a plunger.

12. The stamping device described in claim 2, wherein the stamp mounting block is mounted directly to the slider.

13. The stamping device described in claim 1, wherein the elastic member is selected from the group consisting of a coil tension spring, a compression spring member, and a compressively deformable elastically-deformable member.

* * * * *